US005685806A

United States Patent [19]

Yu

[11] Patent Number: 5,685,806

[45] Date of Patent: Nov. 11, 1997

[54] MAGNETIC DAMPING DEVICE OF AN EXERCISING APPARATUS

[76] Inventor: Hui-Nan Yu, 12F-1, No. 311, Sec. 4, Chung Hsiao E. Road, Taipei, Taiwan

[21] Appl. No.: 673,088

[22] Filed: Jul. 1, 1996

[51] Int. Cl.[6] ..... A63B 22/06

[52] U.S. Cl. ..... 482/63; 482/6

[58] Field of Search ..... 482/57, 61, 62, 482/63, 903, 5–7; 188/267

[56] References Cited

U.S. PATENT DOCUMENTS 4,981,294 1/1991 Dalebout ..... 482/63

5,031,901 7/1991 Saarinen ..... 482/63

5,072,930 12/1991 Sun ..... 482/57

5,236,069 8/1993 Peng ..... 482/63

5,466,203 11/1995 Chen ..... 482/63

*Primary Examiner*—Stephen R. Crow

[57] ABSTRACT

A magnetic damping device including a belt removably and separably positioned around the peripheral groove of the metal flywheel of an indoor exercise bicycle, and a plurality of permanent magnets respectively fastened down the belt and spaced along its length and adapted to impart a magnetic damping resistance to the rotary motion of the metal flywheel.

2 Claims, 4 Drawing Sheets

MAGNETIC DAMPING DEVICE OF AN EXERCISING APPARATUS

BACKGROUND OF THE INVENTION

The present invention relates to damping devices for exercising apparatus, and relates more particularly to a magnetic a damping device for use in an indoor exercise bicycle to give the exercising apparatus with a magnetic damping resistance.

FIG. 4 shows a structure of a regular stationary bicycle for exercising the muscles of the legs. This structure of the stationary bicycle comprises a flywheel (10) and a damping belt (9) disposed around the peripheral annular groove (101) of the flywheel (10). When the flywheel (10) is rotated by a pedal drive, the damping belt (9) imparts a friction resistance to the flywheel (10), therefore the rider shall have to propel pedal drive with much effort for the flywheel maintained rotate. However, the friction resistance from the damping belt reduces gradually with its use because the woven fabric structure of the damping belt becomes loose quickly with use. There are stationary bicycles using brake shoes to impart a friction resistance to the flywheel. However, the brake shoes wear quickly with use. If the brake shoes are used in the stationary bicycle to impart a friction resistance to the flywheel, their positions must be regularly adjusted so that the desired resisting force can be constantly achieved.

SUMMARY OF THE INVENTION

The present invention provides a magnetic damping device of an exercising apparatus which eliminates the aforesaid problems. According to the present invention, the magnetic damping device comprises a fabric belt removably and separably disposed around the peripheral groove of the metal flywheel of an exercising apparatus for example a indoor exercise and a plurality of permanent magnets respectively fastened down the part of the belt and spaced along its length, and then adapted to impart a magnetic damping resistance to the rotary motion of the metal flywheel by the part of the belt with the permanent magnets contacted with the peripheral groove of the metal flywheel.

DETAILED DESCRIPTION OF THE PREFERRED EMBODIMENT

Figure 1B:
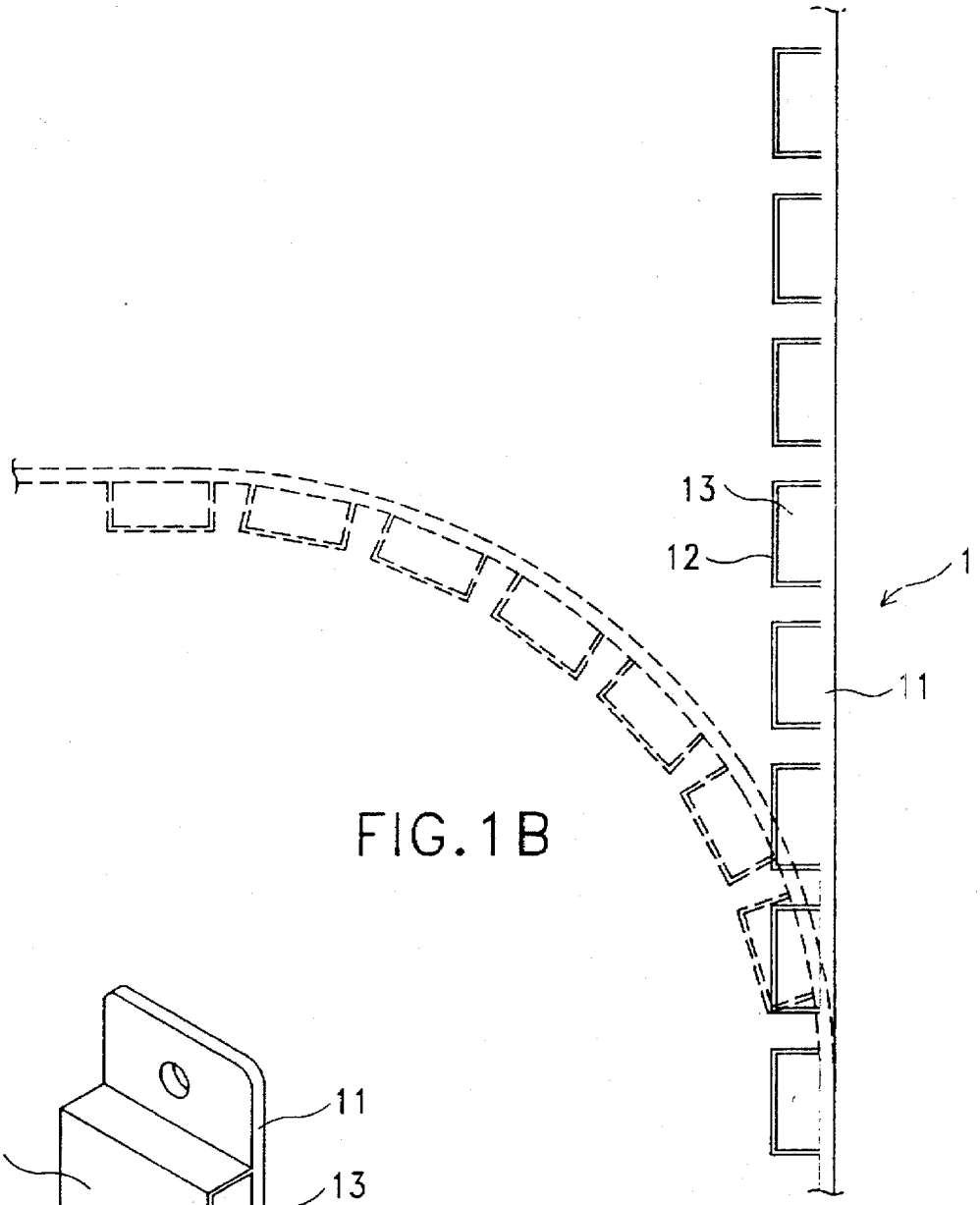
FIG. 1B shows the flexibility of the belt of the magnetic damping device according to the present invention.
Figure 1A:
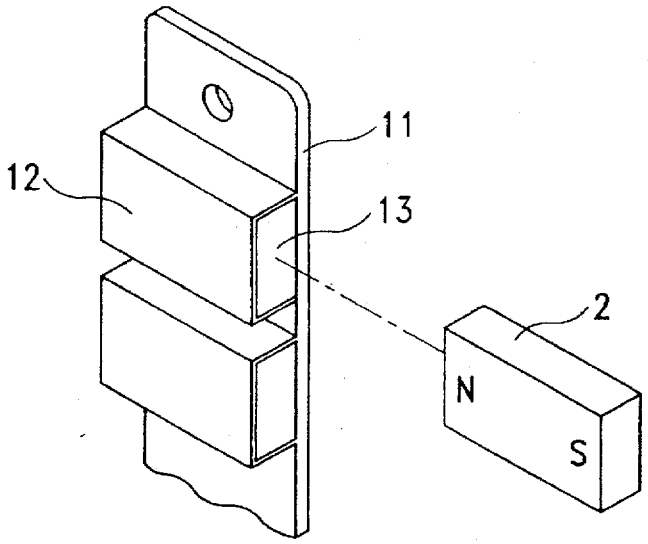
FIG. 1A is an exploded view of a magnetic damping device according to the present invention.

Referring to FIG. 1A and 1B, a magnetic damping device 1 in accordance with the present invention is comprised of a belt 11 having a plurality of pockets 12 spaced along the length at one side, each pocket 12 defining a storage chamber 13, and a plurality of permanent magnets 2 respectively fastened down the storage chambers 13 of the pockets 12. The belt 11 is preferably made from woven fabrics. When the permanent magnets 2 are respectively fastened down the storage chambers 13 of the pockets 12, the pockets 12 are sealed by stitches.

Figure 2A:
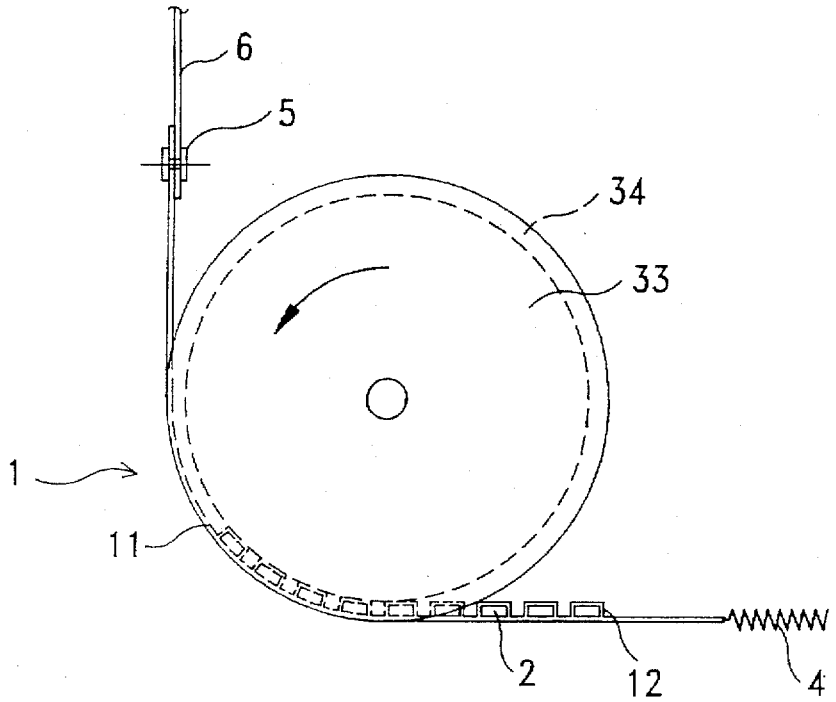
FIG. 2A is an applied view of the present invention, showing the magnetic damping device removably and separably disposed around the peripheral groove of a metal flywheel and connected between a buffer spring and a drag strap.
Figure 2B:
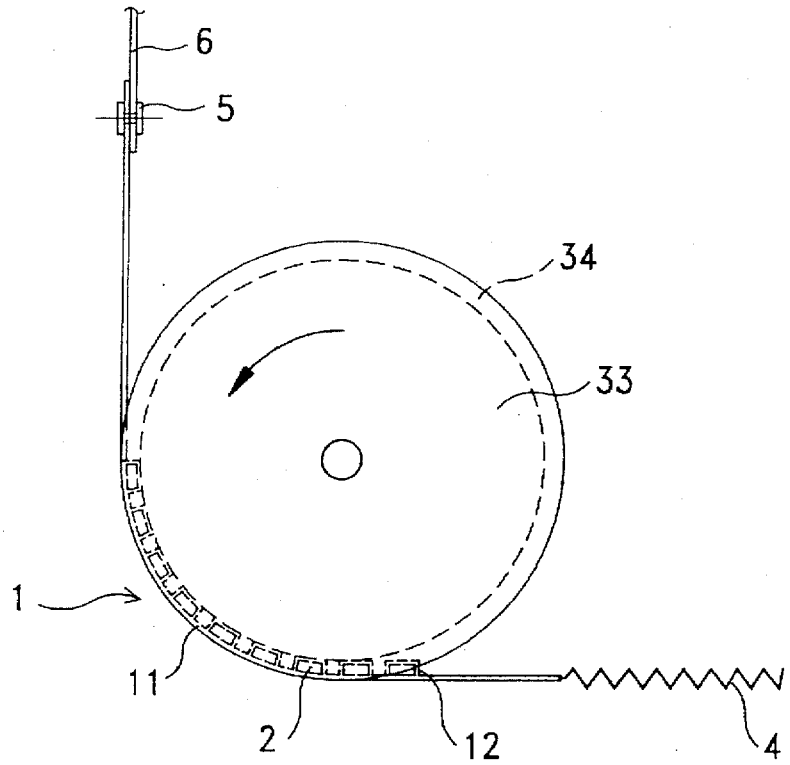
FIG. 2B is similar to FIG. 2A but showing the buffer spring of the magnetic damping device is stretched as rider want to raise the damping resistance.

Referring to FIG. 2A, the magnetic damping device 1 is removably and separably disposed around the peripheral groove 34 of a metal flywheel 33, having one end connected to a buffer spring 4, and an opposite end connected to a drag strap 6 by a connector 5. When installed, the magnetic force of the permanent magnets 2 attracts the peripheral groove of the metal flywheel 33, therefore a damping resistance is produced against the rotary motion when the metal flywheel 33 is rotated. When the buffer spring 4 is stretched as shown in FIG. 2B, more the pockets 12 with permanent magnets 2 of the belt 11 are moved into contact with the flywheel 33, and the damping resistance is instant increase between the belt 11 and the metal flywheel 33.

Figure 3:
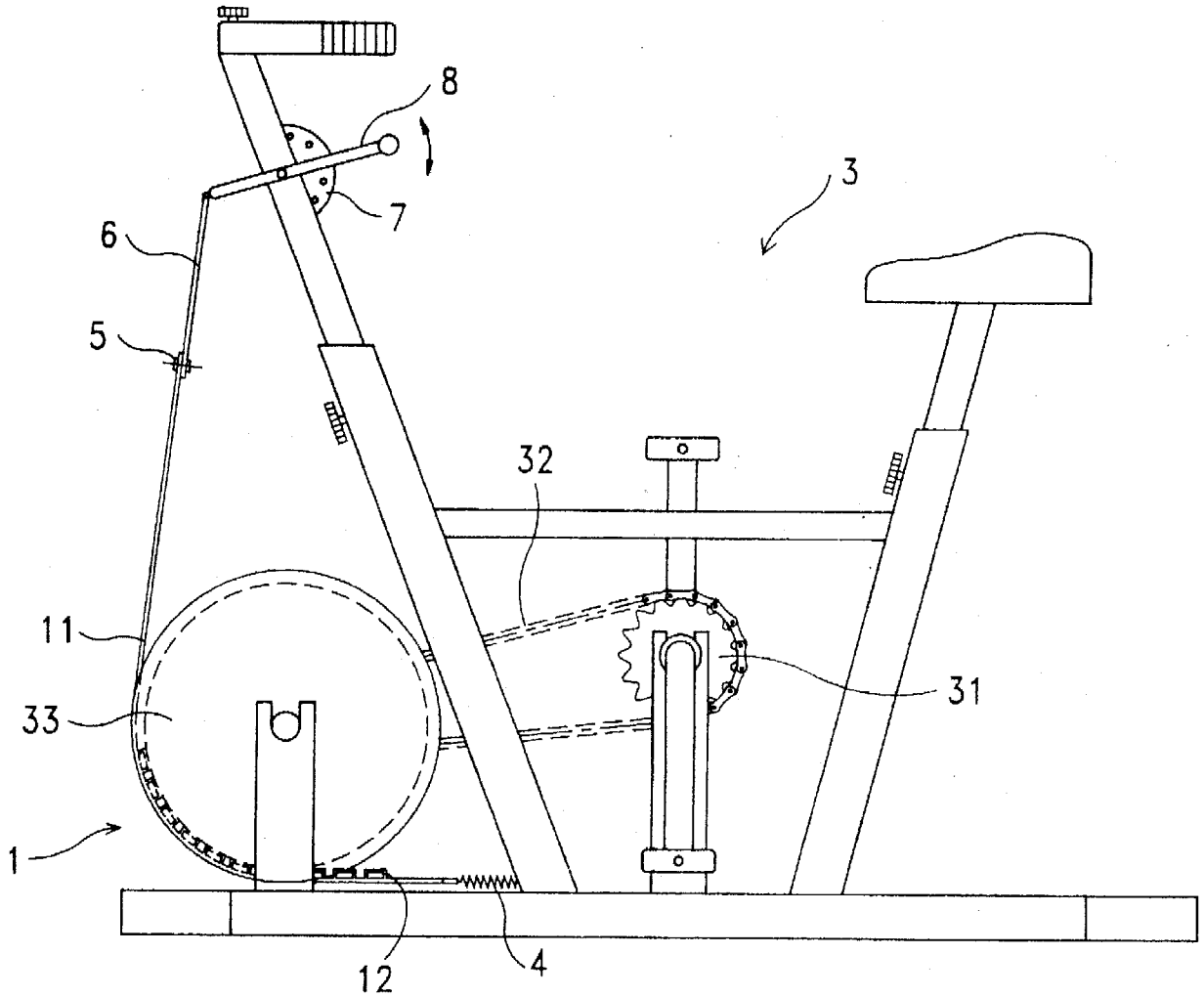
FIG. 3 is an applied view of the present invention, showing the magnetic damping device installed in a indoor exercise bicycle.
Figure 4:
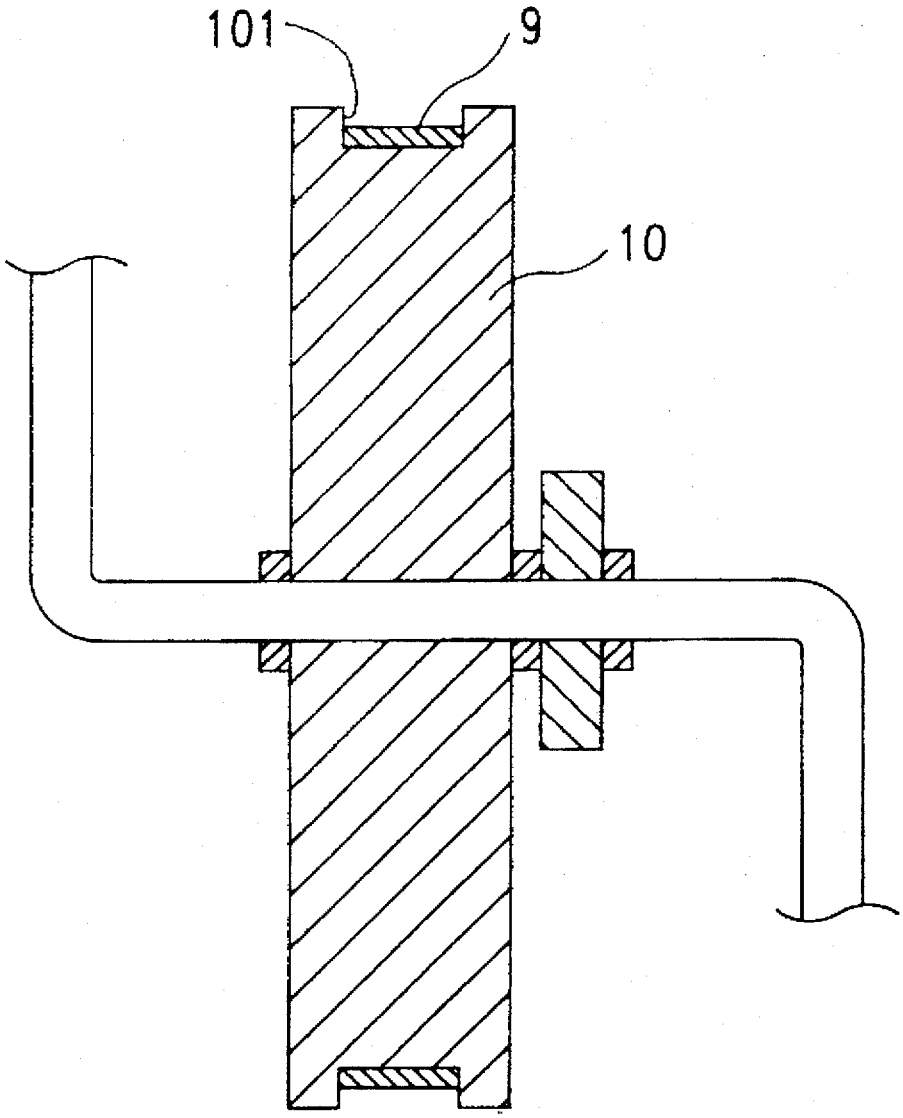
FIG. 4 (PRIOR ART)
FIG. 4 is a sectional view showing a damping belt disposed around the peripheral annular groove of the flywheel of a stationary bicycle according to the prior art.

FIG. 3 shows the magnetic damping device 1 of the present invention installed in a indoor exercise bicycle. As illustrated, the magnetic damping device 1 is removably and separably disposed around a peripheral groove of a metal flywheel 33, having one end connected to a buffer spring 4, and an opposite end connected to a drag strap 6 by a connector 5. The opposite end of the drag strap 6 is connected to a link 8, which is coupled to a holder frame 7. When the line 8 is rotated to pull the drag strap 6, the buffer spring 4 is stretched as show in FIG. 2B. So the damping resistance between the belt 11 and the metal flywheel 33 is controlled by the link 8. The metal flywheel 33 is coupled to a chain wheel 31 by a chain 32. When the chain wheel 31 is propelled to turn the metal flywheel 33 through the chain 32, the permanent magnets 2 of the magnetic damping device 1 give a magnetic damping resistance to the metal flywheel 33.

It is to be understood that the drawings are designed for purposes of illustration only, and are not intended as a definition of the limits and scope of the invention disclosed.

What the invention claimed is:

1. A magnetic damping device for indoor exercise bicycle comprising a belt means for removably and separably disposing said belt around a peripheral groove of a metal flywheel of an exercising apparatus, said belt having a plurality of pockets spaced along the length, and a plurality of permanent magnets installed in said pockets and adapted to impart a magnetic damping resistance to the rotary motion of said metal flywheel, said belt is made from woven fabrics, and said metal flywheel is driven by a pedal drive through a chain system.

2. The magnetic damping device of claim 1 wherein said pockets are sealed by stitches after the installation of said permanent magnets.

* * * * *